US005931079A

United States Patent [19]

Kazahaya

[11] Patent Number: 5,931,079

[45] Date of Patent: Aug. 3, 1999

[54] VARIABLE CAPACITY SWASH PLATE COMPRESSOR

[75] Inventor: Yukio Kazahaya, Kawagoe, Japan

[73] Assignee: Zexel Corporation, Tokyo, Japan

[21] Appl. No.: 09/042,924

[22] Filed: Mar. 17, 1998

[30] Foreign Application Priority Data

Mar. 25, 1997 [JP] Japan ..... 9-091454

[51] Int. Cl.[6] ..... F01B 3/00

[52] U.S. Cl. ..... 92/12.2; 92/57; 92/71; 417/269

[58] Field of Search ..... 92/12.2, 71, 57; 91/504, 505; 417/222, 269; 74/60

[56] References Cited

U.S. PATENT DOCUMENTS

| | | | |
|---|---|---|---|
| 4,815,358 | 3/1989 | Smith | 417/269 X |
| 5,336,056 | 8/1994 | Kimura et al. | 417/269 X |
| 5,749,712 | 5/1998 | Umemura | 417/269 |

*Primary Examiner*—Hoang Nguyen
*Attorney, Agent, or Firm*—Frishauf, Holtz, Goodman, Langer & Chick

[57] ABSTRACT

A variable capacity swash plate compressor includes a plurality of pistons slidably received in a plurality of cylinder bores, respectively, a rotating member rigidly fitted on the drive shaft, for rotation in unison with the drive shaft, a swash plate mounted on the drive shaft in a manner tilted with respect to an imaginary plane perpendicular to the drive shaft and axially slidable along the drive shaft, and a linkage interposed between the rotating member and the swash plate, for tiltably connecting the swash plate to the rotating member to cause the swash plate to rotate in unison with the rotating member. The link member is offset by a predetermined amount from a boundary between a compressing piston-side area which receives compression reaction forces from ones of the pistons during the compression stroke and a suction piston-side area which receives tensile reaction forces from ones of the pistons during the suction stroke, toward the compressing piston-side area.

4 Claims, 7 Drawing Sheets

VARIABLE CAPACITY SWASH PLATE COMPRESSOR

BACKGROUND OF THE INVENTION

1. Field of the Invention

This invention relates to a variable capacity swash plate compressor in which the piston stroke length changes according to the inclination of the swash plate.

2. Description of the Prior Art

FIG. 1 shows the whole arrangement of a conventional variable capacity swash plate compressor.

The conventional variable capacity swash plate compressor includes a plurality of cylinder bores 106 axially formed through a cylinder block 101, a plurality of pistons 107 slidably received in the respective cylinder bores 106, a thrust flange 140 rigidly fitted on a drive shaft 105, for rotation in unison with the drive shaft 105, a swash plate 110 which has a central through hole 109 through which the drive shaft 105 extends and is tiltable with respect to an imaginary plane perpendicular to the drive shaft 105 and at the same time along the drive shaft 105, a linkage 141 connecting between the thrust flange 140 and the swash plate 110, such that the swash plate is tiltably driven for rotation in unison with the thrust flange 140, a plurality of shoes 150 that slide sliding surface 110*a* of the swash plate 110 with respect to the circumference of the swash plate 110, a retainer 153 mounted on the swash plate 110 in a manner that allows it to rotate with respect to the swash plate 110, for retaining the shoes 150, and a retainer support plate 155 rigidly fitted on the swash plate 110, for slidably supporting the retainer 153.

A plurality of connecting rods 111 each have one end connected to one of the shoes such that the spherical end may pivot against the shoe 150 and the other end connected to the corresponding piston 107.

FIG. 3 shows the linkage 141 and component parts associated therewith.

The linkage 141 is comprised of a bracket 110*e* formed on a front-side surface 110*c* of the swash plate 110, a linear guide groove 110*f* formed in the bracket 110*e* such that the guide groove 110*f* is inclined with respect to the thrust flange-side surface 110*c*, and a rod 143 screwed into a swash plate-side surface 140*b* of the thrust flange 140. The rod 143 has one spherical end portion 143*a* that is slidably fitted in the guide groove 110*f*.

Torque from an engine, not shown, installed on an automotive vehicle, not shown, is transmitted to the drive shaft 105 to rotate the same. Torque from the drive shaft 105 is transmitted from the thrust flange 140 to the swash plate 110 via the linkage 141 to cause rotation of the swash plate 110 about the drive shaft 105. As the swash plate 110 rotates, the shoes 150 slide against the sliding surface 110*a* of the swash plate 110, along the circumference of the swash plate 110, whereby torque transmitted from the swash plate 110 is converted into the reciprocating motion of the piston 107.

The linkage 141 best shown in FIG. 3 provides the following advantageous effects.

When thermal load on the compressor decreases to produce a moment acting on the swash plate 110 for reducing the inclination angle of the swash plate 110, the center of rotation of the swash plate 110 (i.e. a point of intersection between the axis of the rod 143 and a Y-axis orthogonal to the axis of the drive shaft 105) moves in a direction away from the axis of the drive shaft 105, so that the moment acting on the swash plate 110 is decreased, and when the swash plate 110 tilts through an angle which nulls the moment, control of the compressor becomes stable. The linkage 141 can be assembled with ease, and since the spherical end 143*a* of the rod 143 is slidably fitted in the guide groove 110*f* (in point contact with the same), pinching of the spherical end 143*a* in the guide groove 110*f* hardly occurs even if it is not assembled with a high degree of accuracy.

What should be noted here is that when the compressor is in operation, the swash plate 110 always receives compression reaction forces (the sum of them is represented by P) from the compressing pistons 107 as well as tensile reaction forces (the sum of them is represented by T) from pistons during the suction stroke 107 (see FIG. 3). More specifically, approximately half of the outer peripheral portion (compressing piston-side area) of the swash plate 10 receives the compression reaction forces P, while the other approximately half of the outer periphery (suction piston-side area) of the same receive the tensile reaction forces T. In FIG. 1, the viewer's side (the same as the front side of the sheet of FIG. 1) of the outer periphery of the swash plate 110 with respect to an imaginary plane including the axis of the drive shaft 105 (X-axis) and an axis (Y-axis) which is orthogonal to the axis of the drive shaft 105 and extends on a plane including a top dead center position point of the swash plate and a bottom dead center position point of the same (which extends along a direction of inclination of the swash plate) is the compressing piston-side area, while a remote side (the same as the reverse side of the sheet of FIG. 1) of the outer periphery of the swash plate 110 with respect to the same imaginary plane is the suction piston-side area. In FIG. 3, the upper half of the outer periphery of the swash plate 10 with respect to the axis (X-axis) of the drive shaft 5 is the suction piston-side area, while the lower half of the outer periphery of the same is the compressing piston-side area.

FIG. 4 shows distribution of the compression reaction forces and tensile reaction forces acting on the swash plate. FIG. 2 is a view taken on line A—A of FIG. 1.

If the sum P of the compression reaction forces (these forces or components of the sum P are represented by F1, F2, and F3) acting on the compressing piston-side area of the swash plate 110 is as large as the tensile reaction forces (these forces or components of the sum T are represented by Fi, . . . ) acting on the suction piston-side area of the swash plate 110, and at the same time acting in the same directions parallel to each other at respective locations equally distant from the rotation axis of the drive shaft 105, the two kinds of forces cancel each other to thereby maintain the swash plate 5 in a balanced state.

However, the compression reaction forces act in an opposite direction to the tensile reaction forces, so that torsion moment MT on a fulcrum of P1 or about the Y-axis (in a clockwise direction as viewed in FIG. 2) is produced.

As a result, edges L and R of the central through hole 109 of the swash plate 110 receive the torsion moment MT.

If the torsion moment MT is large, the swash plate 110 is hindered from sliding smoothly along the drive shaft 105, which results in degradation of controllability of the compressor as well as abrasion of contact portions (edges L and R) of the swash plate 110 against the drive shaft 105. Seizure of the compressor may result therefrom.

SUMMARY OF THE INVENTION

It is an object of the invention to provide a variable capacity swash plate compressor having a construction which is capable of reducing the torsion moment acting on a swash plate to thereby decrease load applied to the central through hole of the swash plate, so as to improve controllability of the compressor and at the same time prevent abrasion of contact portions of the swash plate and a drive shaft as well as seizure of the compressor resulting therefrom.

To accomplish the above object, the present invention provides a variable capacity swash plate compressor including a drive shaft, a cylinder block formed therethrough with a plurality of cylinder bores, a plurality of pistons slidably received in the cylinder bores, respectively, a rotating member rigidly fitted on the drive shaft, for rotation in unison with the drive shaft as the drive shaft rotates, a swash plate mounted on the drive shaft in a manner tilted with respect to an imaginary plane perpendicular to the drive shaft and axially slidable along the drive shaft, the swash plate having a sliding surface and a central through hole through which the drive shaft extends, link means interposed between the rotating member and the swash plate, for tiltably connecting the swash plate to the rotating member to cause the swash plate to rotate in unison with the rotating member as the rotating member, a plurality of shoes each arranged on the sliding surface of the swash plate for sliding along a circumference of the swash plate as the drive shaft rotates, a plurality of connecting rods each of which has one end slidably connected to a corresponding one of the shoes and another end connected to a corresponding one of the pistons, a retainer mounted on the swash plate such that the retainer is rotatable with respect to the swash plate, for retaining the shoes, and a retainer support member rigidly fitted on the swash plate, for slidably supporting the retainer, wherein a length of stroke of each of the pistons changes according to an inclination of the swash plate.

The variable capacity swash plate compressor according to the invention is characterized in that the link means is offset by a predetermined amount from a boundary between a compressing piston-side area which receives compression reaction forces from ones of the pistons during the compression stroke and a suction piston-side area which receives tensile reaction forces from ones of the pistons during the suction stroke, toward the compressing piston-side area.

According to the variable capacity swash plate compressor of the invention, since the link means is offset toward the compressing piston-side area, torsion moment acting on the swash plate is extremely decreased. As a result, load applied to the central through hole of the swash plate when the central through hole is brought into engagement with the drive shaft is reduced, whereby the axial movement (tilting motion) of the swash plate becomes smooth. This makes it possible to improve controllability of the compressor and at the same time prevent abrasion of contact portions of the swash plate and the drive shaft and seizure of the compressor resulting therefrom.

Preferably, the link means comprises a bracket formed on a rotating member-side surface of the swash plate, a linear guide groove formed in the bracket in a manner inclined with respect to the rotating member-side surface of the swash plate, and a rod screwed into a swash plate-side surface of the rotating member and having one spherical end portion thereof slidably fitted in the guide groove, the guide groove and the rod being offset toward the compressing piston-side area by the predetermined amount.

According to the preferred embodiment, the guide groove formed in the bracket and the rod having the one spherical end portion slidably fitted in the guide groove, are not located at the boundary between the suction piston-side area and the compressing piston-side area, but offset from the boundary toward the compressing piston-side area as described above, so that load applied to the central through hole of the swash plate when the central through hole is brought into engagement with the drive shaft is reduced, whereby the axial movement (tilting motion) of the swash plate becomes smooth.

Further preferably, the predetermined amount of offset is 10 to 20 mm.

According to this preferred embodiment, the torsion moment acting on the swash plate is decreased to an extremely small value.

The above and other objects, features and advantages of the present invention will become more apparent from the following detailed description taken in conjunction with accompanying drawings.

DETAILED DESCRIPTION OF THE PREFERRED EMBODIMENT

The invention will now be described in detail with reference to drawings showing a preferred embodiment thereof.

Figure 1:
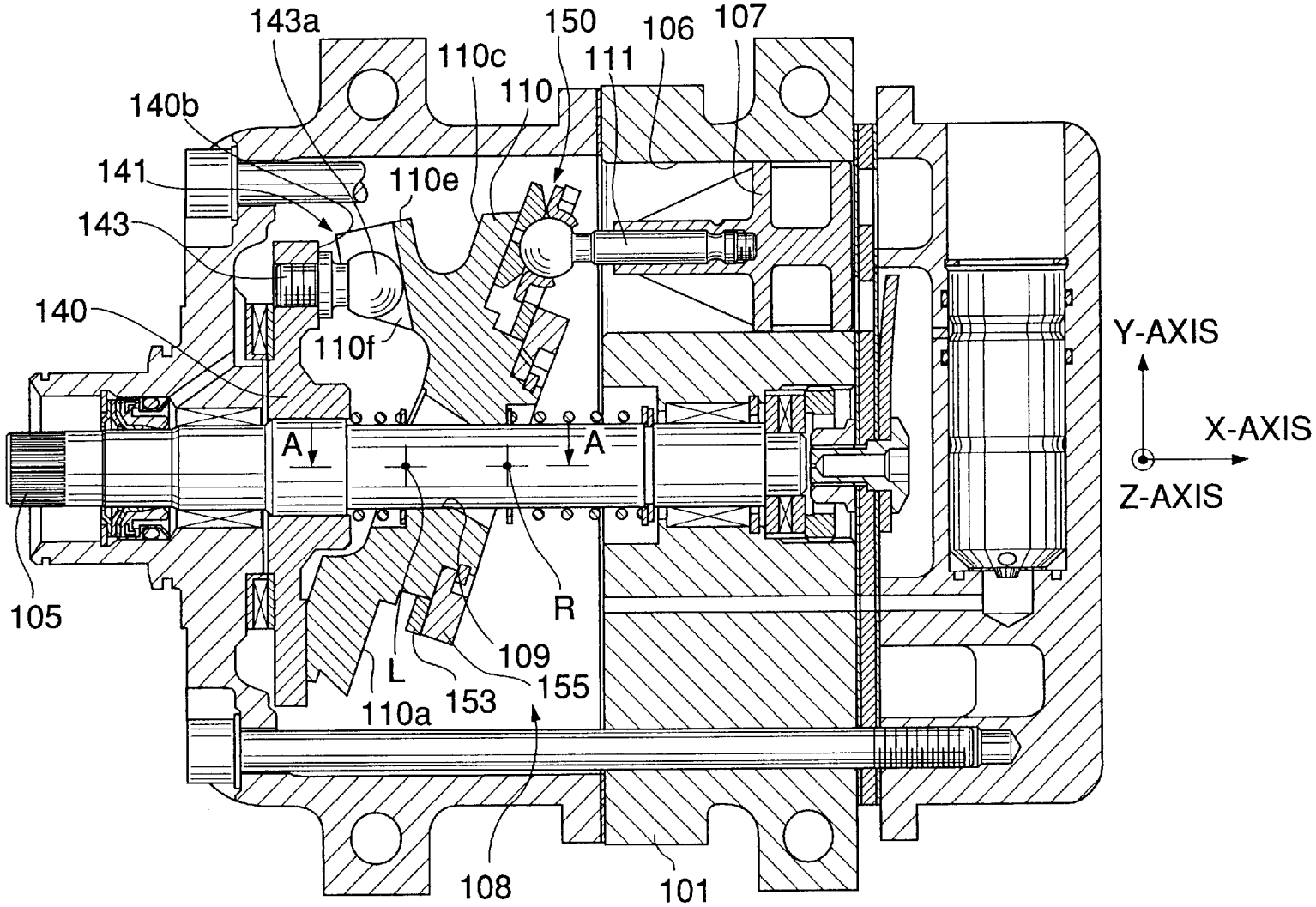
FIG.1 PRIOR ART
FIG. 1 is a longitudinal cross-sectional view showing the whole arrangement of a conventional variable capacity swash plate compressor.
Figure 2:
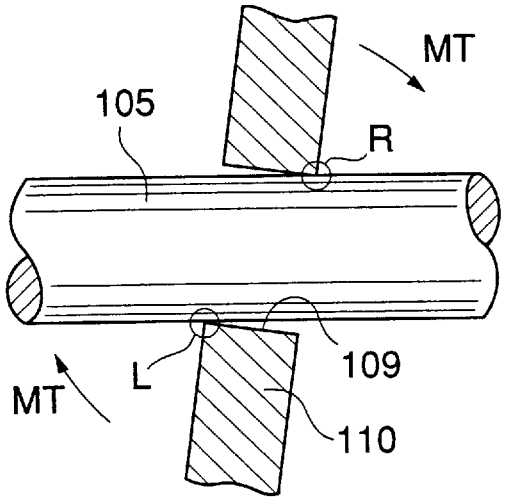
FIG. 2 is a sectional view taken on line A—A of FIG. 1.
Figure 3:
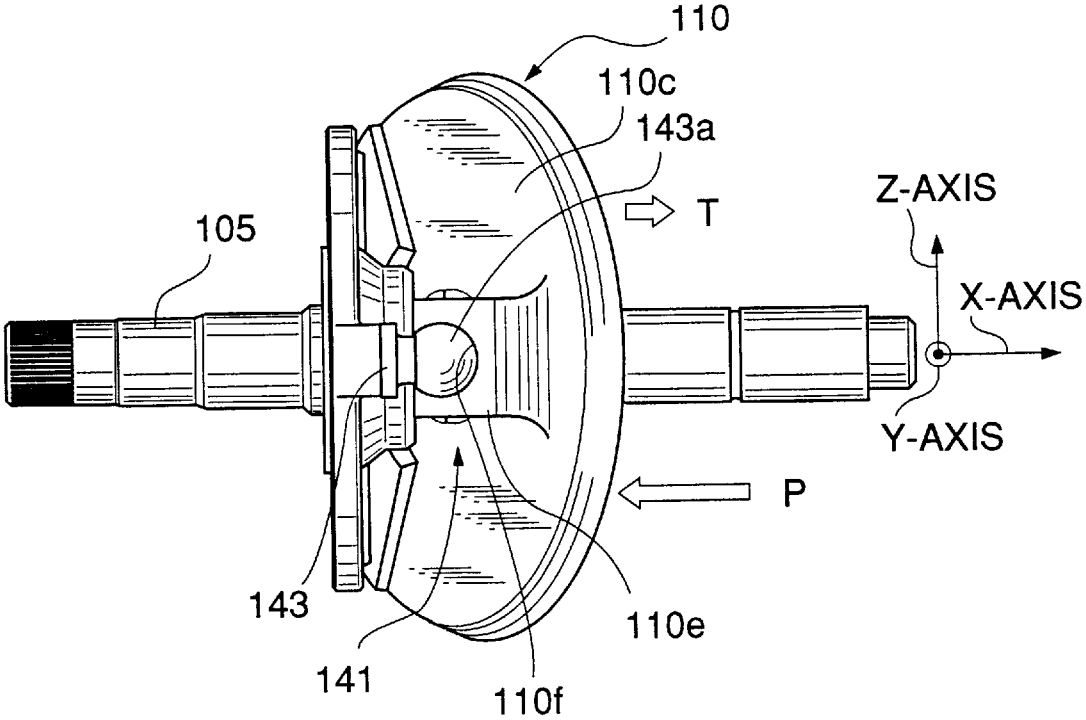
FIG. 3 is a side view showing a linkage and component parts associated therewith, appearing in FIG. 1.
Figure 4:
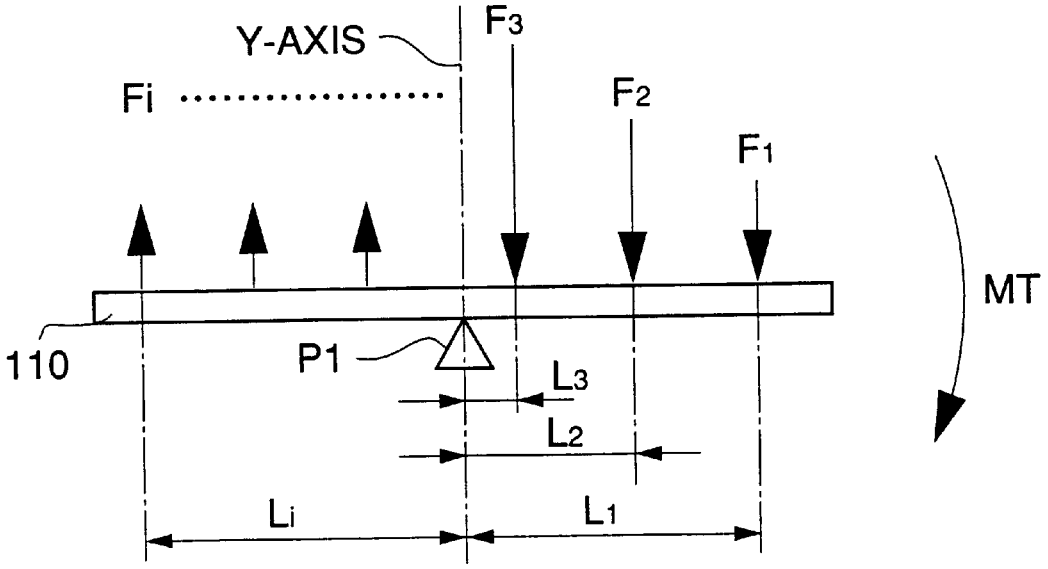
FIG. 4 is a conceptual view showing distribution of compression reaction force and tensile reaction forces acting on the swash plate of the FIG. 1 compressor.
Figure 9:
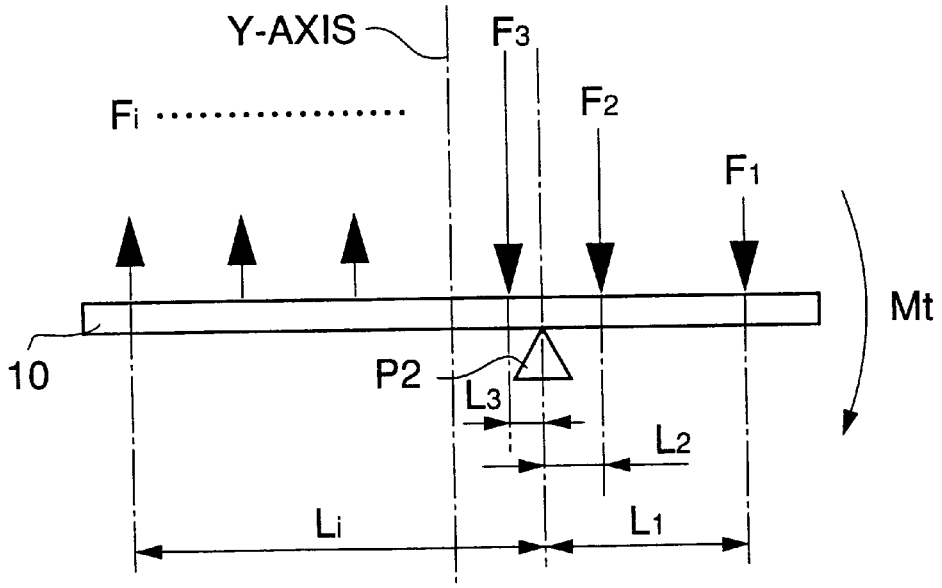
FIG. 9 is a conceptual view showing distribution of compression reaction forces and tensile reaction forces acting on the swash plate of the FIG. 6 compressor.
Figure 5:
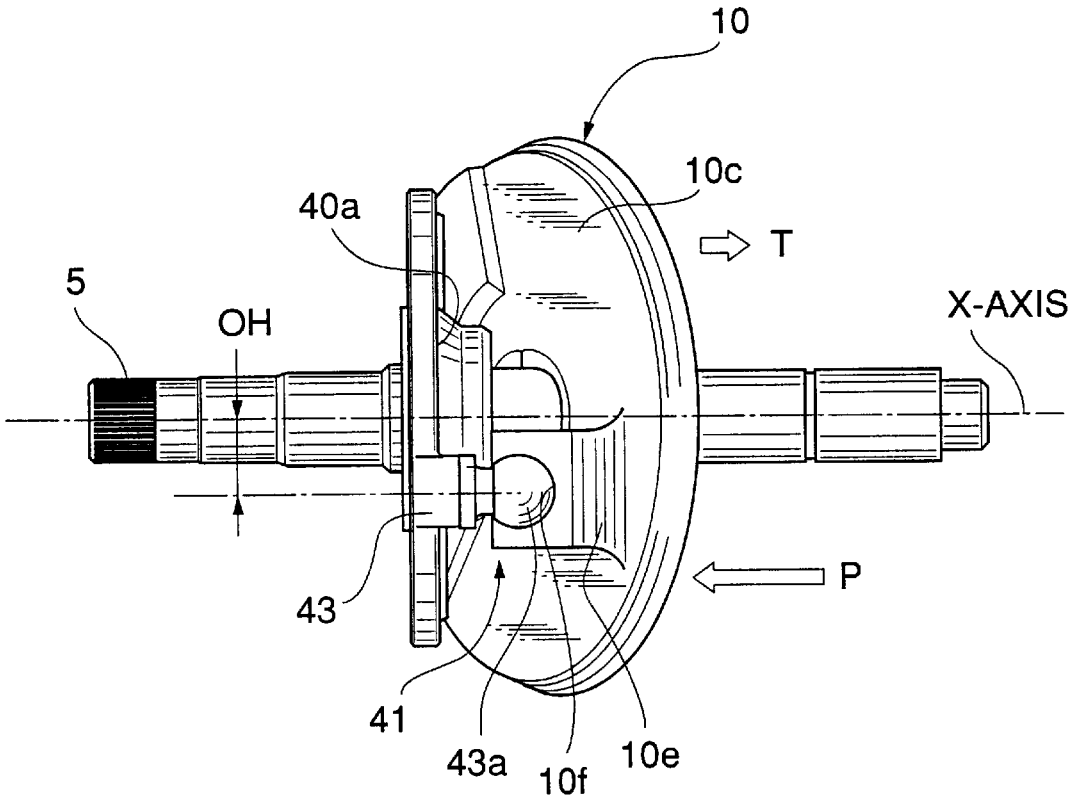
FIG. 5 is a side view showing a linkage and component parts associated therewith of a variable capacity swash plate compressor according to an embodiment of the invention.
Figure 6:
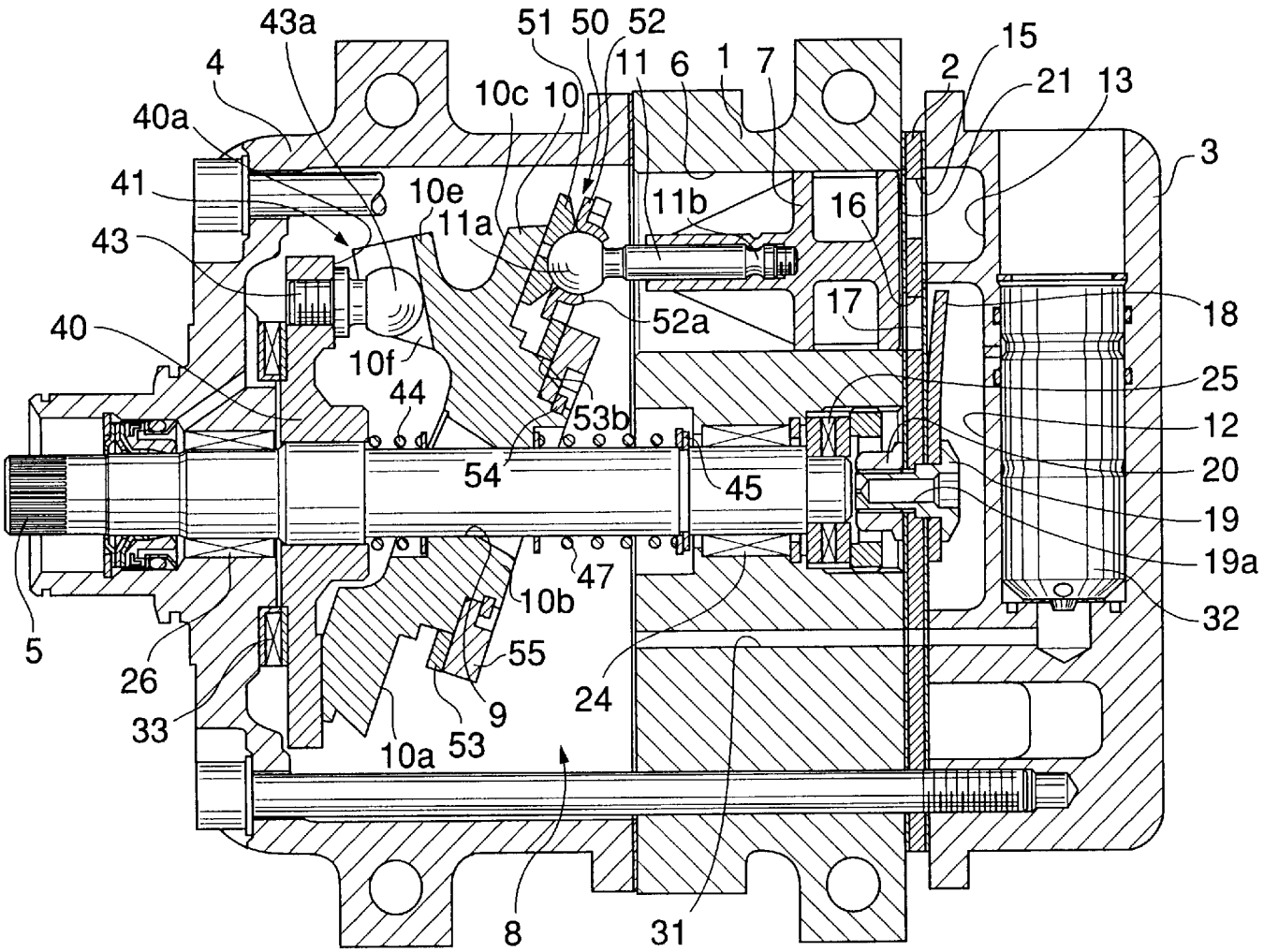
FIG. 6 is a longitudinal cross-sectional view showing the whole arrangement of the variable capacity swash plate compressor according to the embodiment of the invention.
Figure 7:
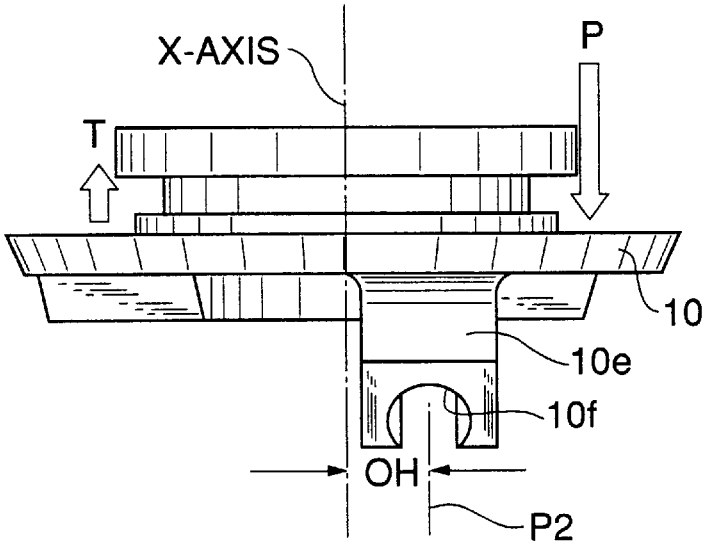
FIG. 7 is a side view of a swash plate appearing in FIG. 6.
Figure 8:
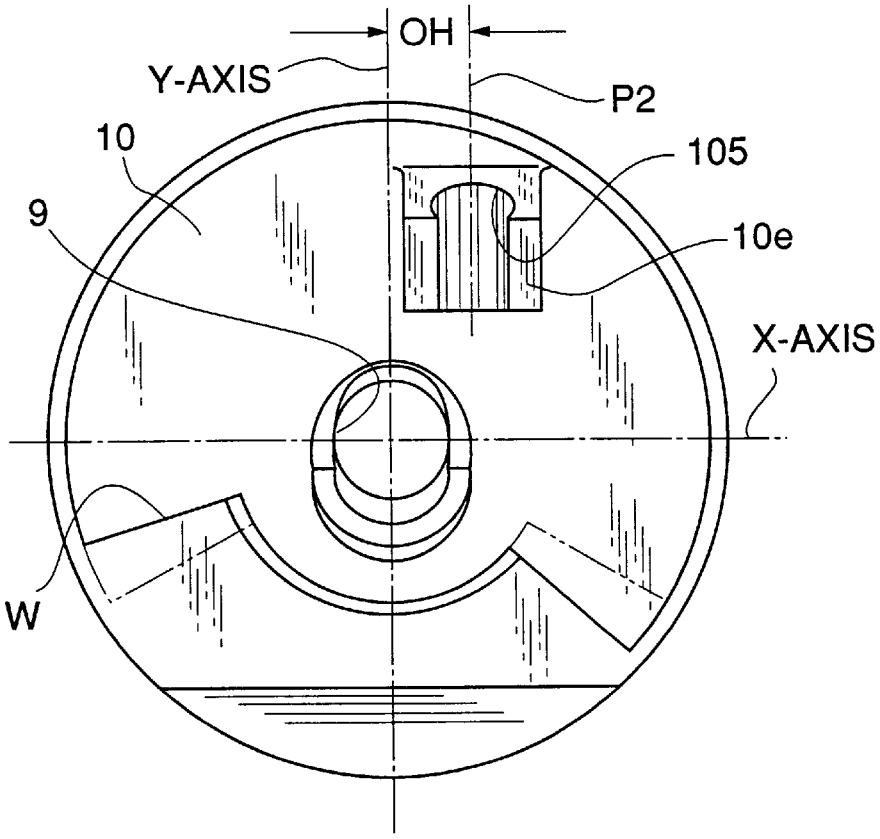
FIG. 8 is a front view of the swash plate appearing in FIG. 6.
Figure 10:
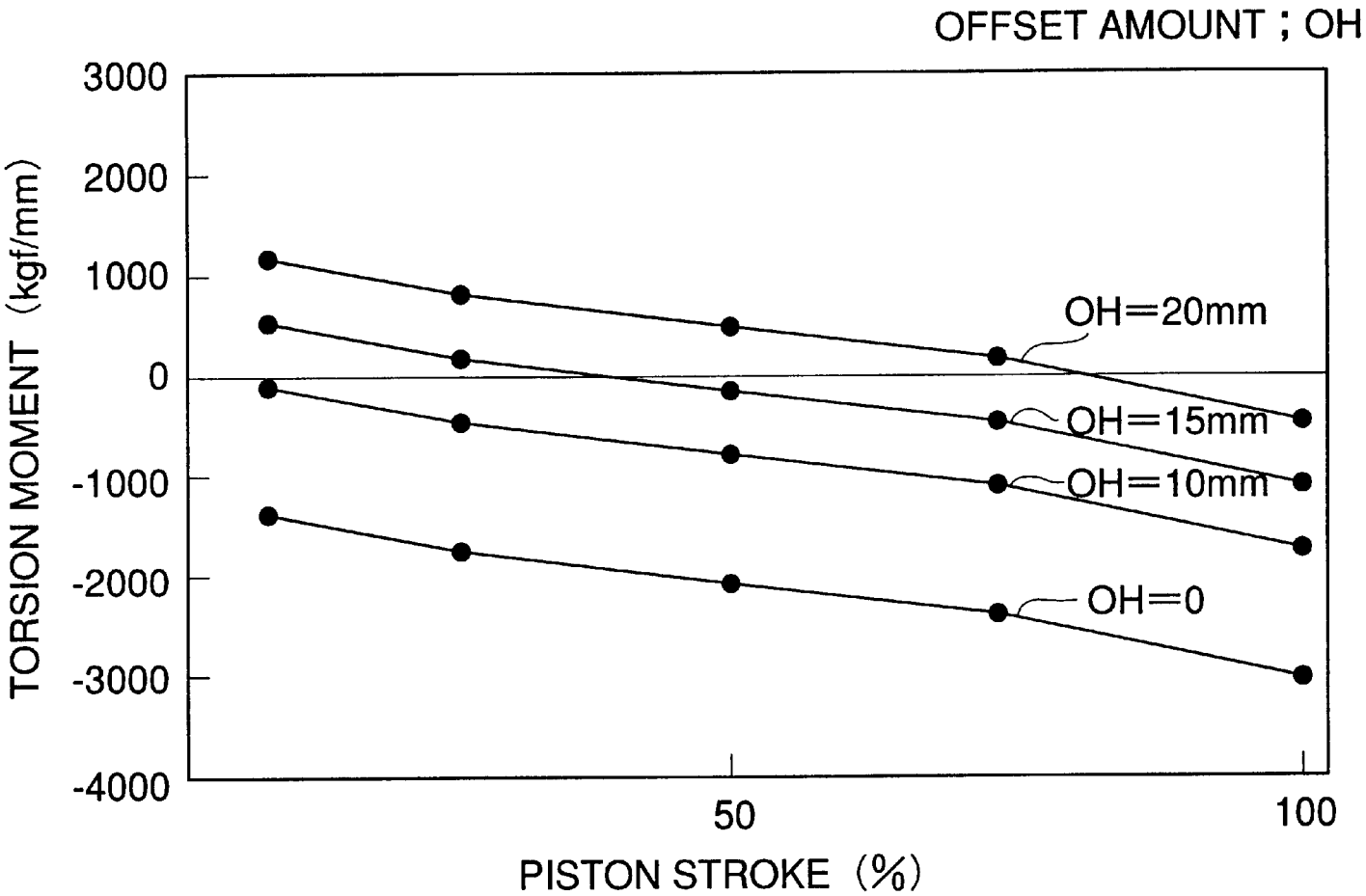
FIG. 10 is a graph showing the relationship between piston stroke and torsion moment, which changes when a linkage is offset.

FIG. 6 shows the whole arrangement of a variable capacity swash plate compressor according to a preferred embodiment of the invention. FIG. 5 shows a linkage and component parts associated therewith. FIG. 7 is a side view of a swash plate, while FIG. 8 is a front view of the same. FIG. 9 shows distribution of compression reaction forces and tensile reaction forces acting on the swash plate. FIG. 10 shows the relationship between the piston stroke and torsion moment, which changes when the linkage is offset.

The variable capacity swash plate compressor has a cylinder block 1 having one end thereof secured to a rear head 3 via a valve plate 2 and the other end thereof secured to a front head 4. The cylinder block 1 has a plurality of cylinder bores 6 axially extending therethrough at predetermined circumferential intervals about a drive shaft 5. Each cylinder bore 6 has a piston 7 slidably received therein.

The front head 4 defines a crankcase 8 in which a swash plate 10 is contained. The swash plate 10 is driven by and rotates in unison with the drive shaft 5. A plurality of shoes 50 on each of which pivots one end 11*a*, spherical in shape, of a corresponding connecting rod 11 are retained on a sliding surface 10*a* of the swash plate 10 by a retainer 53. The retainer 53 is mounted on a boss 10*b* in the swash plate 10 and is supported or held by a retainer support plate (retainer-holding member) 55. The other end of the connecting rod 11 is secured to the corresponding piston.

Each of the shoes 50 is comprised of a first support member 51 for slidably supporting a front-side surface of the one spherical end 11*a* of the corresponding connecting rod 11 such that the one spherical end 11*a* of the connecting rod 11 is relatively rotatable with respect to the first support member 51 and a second support member 52 for slidably supporting or retaining a rear-side surface of the one spherical end 11*a* of the same such that the rear-side surface of the one end 11*a* of the same is relatively rotatable with respect to the second support member 52.

Within the rear head 3, there is formed a discharge chamber 12 with a suction chamber 13 surrounding the discharge chamber 12.

The valve plate 2 is formed with refrigerant outlet ports 16 for each communicating between a compression chamber within a corresponding one of the cylinder bores and the discharge chamber 12 and refrigerant inlet ports 15 for each communicating between a compression chamber within a corresponding one of the cylinder bores 6 and the discharge chamber 12. The refrigerant outlet ports 16 and the refrigerant inlet ports 15 are arranged at predetermined circumferential intervals, respectively, about the drive shaft 5. The refrigerant outlet ports 16 are opened and closed by respective discharge valves 17 formed as a unitary member. The unitary member of the discharge valves 17 is fixed to a rear head-side end face of the valve plate 2 by a bolt 19 and nut 20 together with a valve stopper 18.

The refrigerant inlet ports 15 are opened and closed by respective suction valves 21 formed as a unitary member arranged between the valve plate 2 and the cylinder block 1. The bolt 19 has a guide hole 19*a* used in guiding high-pressure refrigerant gas from the discharge chamber 12 to a radial bearing 24 and a thrust bearing 25.

A rear end of the drive shaft 5 is rotatably supported by the radial bearing 24 and the thrust bearing 25, while a front end of the drive shaft 5 is rotatably supported by a radial bearing 26.

A communication passage 31 is formed between the suction chamber 13 and the crankcase 8 for communication therebetween, and a pressure control valve 32 is provided at an intermediate portion of the communication passage 31 for controlling pressure within the suction chamber 13 and pressure within the crankcase 8.

The drive shaft 5 has a thrust flange (rotating member) 40 rigidly fitted on a front portion thereof for transmitting torque from the drive shaft 5 to the swash plate 10. The thrust flange 40 is rotatably supported on an inner wall of the front head 4 by a thrust bearing 33. The thrust flange 40 and the swash plate 10 are connected with each other via a linkage (connecting means) 41. The swash plate 10 can tilt with respect to an imaginary plane perpendicular to the drive shaft 5.

The linkage 41 is comprised of a bracket 10*e* formed on a front surface 10*c* of the swash plate 10, a linear guide groove 10*f* formed in the bracket 10*e*, and a rod 43 screwed into a swash plate-side surface 40*a* of the thrust flange 40. The longitudinal axis of the guide groove 10*f* is inclined at a predetermined angle with respect to the front surface 10*c* of the swash plate 10. The rod 43 has one spherical end 43*a* thereof slidably fitted in the guide groove 10*f*.

The swash plate 10 has a central through hole 9 through which the drive shaft 5 extends. The swash plate 10 is axially slidably fitted to the drive shaft 5 in a tiltable manner, i.e. such that its angle with respect to the imaginary plane perpendicular to the drive shaft 5 may be varied. On the drive shaft 5 is fitted a coil spring 44 between the thrust flange 40 and the swash plate 10 to urge the swash plate 10 toward the cylinder block 1. Further, the drive shaft 5 has a stopper 45 fitted thereon, and a coil spring 47 is fitted on the drive shaft 5 between the stopper 45 and the swash plate 10 to urge the swash plate 10 toward the thrust flange 40.

When the compressor is in operation, approximately half of the outer periphery (compressing piston-side area) of the swash plate 10 receives compression reaction forces P from the compressing pistons 7, while the other approximately half of the outer periphery (suction piston-side area) of the same receives tensile reaction forces T from the pistons during the suction stroke 7. In FIG. 5, the upper half of the outer periphery of the swash plate 10 with respect to the axis (X-axis) of the drive shaft 5 is the suction piston-side area, while the lower half of the outer periphery of the same is the compressing piston-side area. In FIG. 7, the left half of the swash plate 10 with respect to the axis (X-axis) of the drive shaft 5 is the suction piston-side area, while the right half of the same is the compressing piston-side area, and in FIG. 8, the left half of the outer periphery of the swash plate 10 with respect to a Y-axis orthogonal to the axis (X-axis) of the drive shaft 5 is the suction piston-side area, while the right half of the outer periphery of the same is the compressing piston-side area.

As shown in FIGS. 5, 7 and 8, the linkage 41 is offset (by an offset amount OH) toward the compressing piston-side area. More specifically, the guide groove 10*f* formed in the swash plate 10 and the rod 43 having the spherical end 43*a* fitted in the guide groove 10*f*, both of which are essential parts of the linkage 41, are not located at a boundary between the suction piston-side area and the compressing piston-side area, but shifted toward the compressing piston-side area by a predetermined amount (offset amount).

Further, with the offset of the linkage 41 toward the compressing piston-side area, a balance weight W is shifted, as shown in FIG. 8, in a direction away from the guide groove 10*f* (i.e. from a location illustrated by a full line to a location illustrated by a two-dot chain line), so as to maintain a balance of rotation of the swash plate 10.

Next, the operation of the variable capacity swash plate compressor constructed as above will be described.

Torque from an engine, not shown, installed on an automotive vehicle, not shown, is transmitted to the drive shaft 5 to rotate the same. Torque from the drive shaft 5 is transmitted to the swash plate 10 via the thrust flange 40 and the linkage 41 to cause rotation of the swash plate 10.

When the swash plate 10 is rotated, the shoes 50 slide along the sliding surfaces 10*a*. Because of the angle that the swash plate is mounted in with respect to the imaginary plane perpendicular to the crank shaft, the torque transmitted from the swash plate 10 is converted into the reciprocating motion of each piston 7. As the piston 7 reciprocates within the cylinder bore 6 the volume of the compression chamber within the cylinder bore 6 changes. As a result, suction, compression and delivery of refrigerant gas are sequentially carried out in the compression chamber, whereby high-pressure refrigerant gas is delivered from the compression chamber in an amount corresponding to the inclination of the swash plate 10. During the suction stroke, the suction valve 21 opens to draw low-pressure refrigerant gas from the suction chamber 13 into the compression chamber within the cylinder bore 6. During the discharge cycle, the discharge valve 17 opens to deliver high-pressure refrigerant gas from the compression chamber to the discharge chamber 12.

When thermal load on the compressor decreases, the pressure control valve 32 closes the communication passage 31, whereby pressure within the crankcase 8 is increased to decrease the inclination of the swash plate 10. As a result, the length of stroke of the piston 7 is decreased to reduce the delivery quantity or capacity of the compressor. In the meantime, the spherical end 43*a* of the rod 43 of the linkage 41 slides along the guide groove 10*f* to one end of the same.

When the thermal load on the compressor increases, the pressure control valve 32 opens the communication passage 31, whereby the pressure within the crankcase 8 is lowered to increase the inclination of the swash plate 10. As a result, the length of stroke of the piston 7 is increased to increase the delivery quantity or capacity of the compressor. In the meantime, the spherical end 43*a* of the rod 43 of the linkage 41 slides along the guide groove 10*f* to the other end of the same.

When the piston 7 is in linear reciprocating motion, the swash plate 10 always receives compression reaction forces P from pistons 7 during the compression stroke, i.e. forces of the pistons 7 during the compression stroke acting to push the swash plate 10 as well as tensile reaction forces T from pistons 7 during the suction stroke, i.e. forces of the pistons 7 during the suction stroke acting to pull the swash plate 10, as shown in FIGS. 5 and 7.

The compression reaction forces act in an opposite direction to the tensile reaction forces. However, since the linkage 41 is offset to a predetermined location in the compressing piston-side area, a compression reaction force F3, i.e. a component of the sum P of the compression reaction forces, acts as a negative tensile reaction force on a point L3 located on a suction piston side of the swash plate 10 with respect to a fulcrum P2, as shown in FIG. 9. As a result, the sum P of compression reaction forces (F1+F2) becomes substantially equal to the sum (ΣFi+F3) of the tensile reaction forces T which assumes a negative value or acting in the same direction as the compression reaction forces.

Therefore, the torsion moment Mt about the fulcrum P2 is decreased to an extremely small value.

FIG. 10 shows that if a bore pitch is 80 mm, the value of the torsion moment Mt is much smaller when the offset amount OH is 10 to 20 mm than when the offset amount OH is equal to 0. The torsion moment Mt has the minimum value when OH=15 mm, provided that suction pressure Ps=1.8 (Kgf/cm$^2$), discharge pressure Pd=15.5 (Kgf/cm$^2$), and rotational speed N=1800 (r/min) hold.

According to the variable capacity swash plate compressor of the embodiment, since the linkage 41 is offset toward the compressing piston-side area, the torsion moment acting on the swash plate 10 is decreased to an extremely small value. As a result, load applied to the central through hole 9 of the swash plate 10 when the central through hole 9 is brought into engagement with the drive shaft 5 is reduced, whereby the axial movement (tilting motion) of the swash plate 10 becomes smooth. This makes it possible to improve controllability of the compressor and at the same time prevent abrasion of contact portions of the swash plate 10 and the drive shaft 5 and seizure of the compressor resulting therefrom.

Although according to the above embodiment, the linkage 41 is comprised of the bracket 10*e*, the linear guide groove 10*f* formed in the bracket 10*e*, and the rod 43 screwed into the swash plate-side surface 40*a* of the thrust flange 40, this is not limitative, but the linkage may be formed by an arm formed on a front-side surface of the swash plate, a slot formed through the arm, a pair of projections formed on the swash plate-side surface of the thrust flange, and a pin extending between the two projections, for engagement with the slot. The linkage may have any construction so long as the linkage is capable of linking the swash plate 40 to the thrust flange 40 such that it is able to vary the angle of the swash plate 40.

It is further understood by those skilled in the art that the foregoing is the preferred embodiment and variations of the invention, and that various changes and modifications may be made without departing from the spirit and scope thereof.

What is claimed is:

1. In a variable capacity swash plate compressor including a drive shaft, a cylinder block formed therethrough with a plurality of cylinder bores, a plurality of pistons slidably received in said cylinder bores, respectively, a rotating member rigidly fitted on said drive shaft, for rotation in unison with said drive shaft as said drive shaft rotates, a swash plate mounted on said drive shaft in a manner tilted with respect to an imaginary plane perpendicular to said drive shaft and axially slidable along said drive shaft, said swash plate having a sliding surface and a central through hole through which said drive shaft extends, link means interposed between said rotating member and said swash plate, for tiltably connecting said swash plate to said rotating member to cause said swash plate to rotate in unison with said rotating member as said rotating member, a plurality of shoes each arranged on said sliding surface of said swash plate for sliding along a circumference of said swash plate as said drive shaft rotates, a plurality of connecting rods each of which has one end slidably connected to a corresponding one of said shoes and another end connected to a corresponding one of said pistons, a retainer mounted on said swash plate such that said retainer is rotatable with respect to said swash plate, for retaining said shoes, and a retainer support member rigidly fitted on said swash plate, for slidably supporting said retainer, wherein a length of stroke of each of said pistons changes according to an inclination of said swash plate, the improvement wherein said link means is offset by a predetermined amount from a boundary between a compressing piston-side area which receives compression reaction forces from ones of said pistons during the compression stroke and a suction piston-side area which receives tensile reaction forces from ones of said pistons during the suction stroke, toward said compressing piston-side area.

2. A variable capacity swash plate compressor according to claim 1, wherein said link means comprises a bracket formed on a rotating member-side surface of said swash plate, a linear guide groove formed in said bracket in a manner inclined with respect to said rotating member-side surface of said swash plate, and a rod screwed into a swash plate-side surface of said rotating member and having one spherical end portion thereof slidably fitted in said guide groove, said guide groove and said rod being offset toward said compressing piston-side area by said predetermined amount.

3. A variable capacity swash plate compressor according to claim 1, wherein said predetermined amount of offset is 10 to 20 mm.

4. A variable capacity swash plate compressor according to claim 2, wherein said predetermined amount of offset is 10 to 20 mm.

* * * * *